United States Patent [19]

Sentementes et al.

[11] 4,079,350

[45] Mar. 14, 1978

[54] THERMISTOR SENSORS

[75] Inventors: Thomas J. Sentementes, Wakefield, Mass.; Peter Levett, Barcelona, Spain

[73] Assignee: GTE Sylvania Incorporated, Danvers, Mass.

[21] Appl. No.: 740,988

[22] Filed: Nov. 11, 1976

[51] Int. Cl.[2] ..... H01C 7/02

[52] U.S. Cl. ..... 338/22 R; 338/226; 338/254; 338/256

[58] Field of Search ..... 338/22 R, 22 SD, 212, 338/214, 25, 226, 254, 255, 256, 322, 323, 329, 333, 334; 29/612, 613, 619, 621; 219/549, 528; 73/362 AR

[56] References Cited

U.S. PATENT DOCUMENTS

| | | | |
|---|---|---|---|
| 3,866,158 | 2/1975 | Reber et al. | 338/25 |
| 3,889,362 | 6/1975 | Tyler | 29/619 |

FOREIGN PATENT DOCUMENTS

| | | | |
|---|---|---|---|
| 1,257,148 | 12/1971 | United Kingdom | 338/22 R |

*Primary Examiner*—C. L. Albritton
*Attorney, Agent, or Firm*—James Theodosopoulos

[57] ABSTRACT

A sensor for detecting a rapid temperature rise comprises a thermistor chip electroded on opposing faces and having lead-in wires electrically connected to the faces. The thermistor chip is encapsulated between two ribbons of plastic film which, in turn, are encapsulated between two sheets of copper foil which, in turn, are encapsulated between two layers of plastic film.

5 Claims, 2 Drawing Figures

THERMISTOR SENSORS

THE INVENTION

Figure 1:
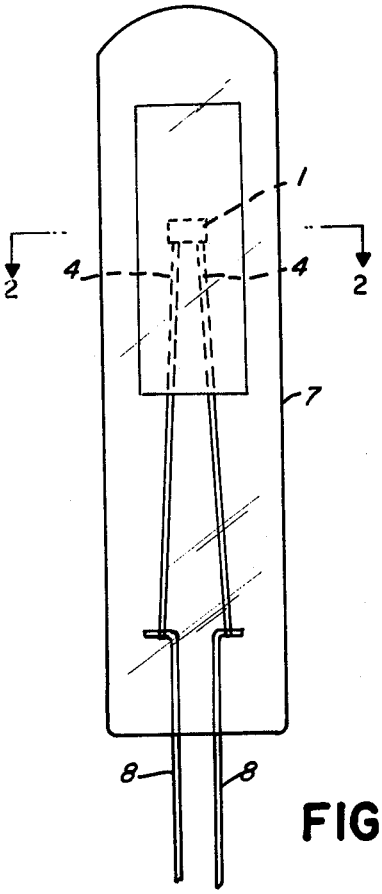

This invention concerns thermistor sensors which can be used to detect a rapid rise in temperature in the stator windings of electric motors caused by, for example, a locked rotor or a running overload. The sensor is small, relatively flat and rugged enough to be inserted into a stator winding.

The sensor comprises a small chip of thermistor material suitably encapsulated for protection, the encapsulation including a strip of copper to improve heat transfer to the chip.

In the drawing,

FIG. 1 is a plane view and

Figure 2:
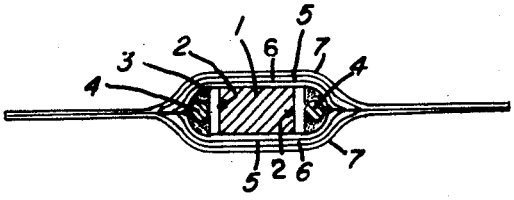

FIG. 2 a cross-sectional view of a thermistor sensor in accordance with this invention.

As shown in the drawing, the sensor comprises a small chip 1 of thermistor material, either NTC or PTC. In one example, chip 1 comprised barium titanate and was a small cube measuring 50 mils on each side. Two opposing faces 2 were electroded in the usual manner, as shown, for example, in U.S. Pat. No. 3,793,604. Fastened in an electrically conductive manner to faces 2, either by soldering or by means of electrically conductive adhesive, indicated by the numeral 3 in FIG. 2, were small diameter lead-in wires 4. In said example, lead-in wires 4 were 30 AWG teflon coated copper wires about 1½ inches long.

Chip 1 is then sealed between two ribbons 5 of suitable plastic film as shown in FIG. 2. In said example, the film comprised a polymide tape having a pressure sensitive silicone adhesive on one surface and which could be used at temperatures up to 500° F. The thickness of the film was 2½ mils and each ribbon 5 was ¼ inch wide by ¾ inch long. Chip 1 with wires 4 attached was centrally placed between ribbons 5, the adhesive surfaces facing each other, and the ribbons sealed together, completely encapsulating chip 1 therewithin.

Next, the assembly was similarly encapsulated between two sheets 6 of 1 mil copper foil having a 1½ mil thick pressure sensitive silicone adhesive thereon. Each sheet 6 was 5/16 inch wide by 1 inch long and completely overlapped underlying ribbon 5 as shown in FIG. 2.

Finally, the assembly was similarly sealed between two larger, thicker ribbons 7 of the same plastic film as before, ribbons 7 being 3½ mils thick. Each ribbon 7 was ¾ inch wide by 3 inches long. Prior to this sealing step, the ends of lead-in wires 4 were electrically connected to heavier gauge wires 8, for example 20AWG teflon coated lead-in wires, at a region proximate enough so that the connection was sealed between ribbons 7.

We claim:

1. A sensor for detecting a rapid temperature rise comprising a chip of thermistor material electroded on opposing faces and having lead-in wires electrically connected to said faces, said chip being encapsulated between two ribbons of plastic film, the assembly of the chip and two ribbons of plastic film being encapsulated between two sheets of copper foil, the entire assembly being encapsulated between two layers of plastic film.

2. The sensor of claim 1 wherein the ribbons of plastic film are bonded to each other by means of pressure sensitive adhesive thereon.

3. The sensor of claim 1 wherein the layers of plastic film are thicker than the ribbons of plastic film.

4. The sensor of claim 1 wherein said lead-in wires are connected to larger diameter lead-in wires.

5. The sensor of claim 4 wherein the points of connection of said lead-in wires to said large diameter lead-in wires is embedded between said two layers of plastic film.

* * * * *